US005091360A

United States Patent [19]

Gemmell et al.

[11] Patent Number: 5,091,360

[45] Date of Patent: Feb. 25, 1992

[54] THERMAL TRANSFER PRINTING

[75] Inventors: Peter A. Gemmell, Bentley; Carol Leliaert, Great Dunmow, both of United Kingdom

[73] Assignee: Imperial Chemical Industries PLC, London, England

[21] Appl. No.: 522,038

[22] Filed: May 11, 1990

[30] Foreign Application Priority Data

May 26, 1989 [GB] United Kingdom ..... 8912164

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 913914; 503/227

[56] References Cited

U.S. PATENT DOCUMENTS

| | | | |
|---|---|---|---|
| 4,743,581 | 5/1988 | Gregory | 503/227 |
| 4,764,178 | 8/1988 | Gregory et al. | 8/471 |
| 4,824,437 | 4/1989 | Gregory | 8/471 |
| 4,968,657 | 11/1990 | Gregory et al. | 503/227 |

*Primary Examiner*—Bruce H. Hess

*Attorney, Agent, or Firm*—Cushman, Darby & Cushman

[57] ABSTRACT

A thermal transfer printing sheet suitable for the printing of black images in a dye diffusion thermal transfer printing process. The sheet comprises a substrate having a coating comprising a black dye mixture comprising from 5 to 60% of a dye of Formula 1, from 5 to 60% of Formula 2, from 5 to 60% of a dye of Formula 3 and/or from 1 to 60% of a dye of Formula 4.

25 Claims, No Drawings

THERMAL TRANSFER PRINTING

INTRODUCTION

This invention relates to dye diffusion thermal transfer printing (DDTTP), especially to a DDTTP transfer sheet carrying a mixture of dyes and to the use of the transfer sheet in conjunction with a receiver sheet in a DDTTP process.

It is known to print woven or knitted textile material by a thermal transfer printing (TTP) process. In such a process a sublimable dye is applied to a paper substrate (usually as an ink also containing a resinous or polymeric binder to bind the dye to the substrate until it is required for printing) in the form of a pattern, to produce a transfer sheet comprising a paper substrate printed with a pattern which it is desired to transfer to the textile. Substantially all the dye is then transferred from the transfer sheet to the textile material, to form an identical pattern on the textile material, by placing the patterned side of the transfer sheet in contact with the textile material and heating the sandwich, under light pressure from a heated plate, to a temperature from 180°-220° C. for a period of 30-120 seconds.

As the surface of the textile substrate is fibrous and uneven it will not be in contact with the printed pattern on the transfer sheet over the whole of the pattern area. It is therefore necessary for the dye to be sublimable and vaporise during passage from the transfer sheet to the textile substrate in order for dye to be transferred from the transfer sheet to the textile substrate over the whole of the pattern area.

As heat is applied evenly over the whole area of the sandwich over a sufficiently long period for equilibrium to be established, conditions are substantially isothermal, the process is non-selective and the dye penetrates deeply into the fibres of the textile material.

In DDTTP, a transfer sheet is formed by applying a heattransferable dye or dye mixture to a thin (usually <20 micron) substrate having a smooth plain surface (usually as an ink also containing a polymeric or resinous binder to bind the dye to the substrate) in the form of a continuous even film over the entire printing area of the transfer sheet. Dye is then selectively transferred from the transfer sheet by placing it in contact with a material having a smooth surface with an affinity for the dye, hereinafter called the receiver sheet, and selectively heating discrete areas of the reverse side of the transfer sheet for periods from about 1 to 20 milliseconds (msec) and temperatures up to 300° C., in accordance with a pattern information signal whereby dye from the selectively heated regions of the transfer sheet is transferred to the receiver sheet and forms a pattern thereon in accordance with the pattern in which heat is applied to the transfer sheet. The shape of the pattern is determined by the number and location of the discrete areas which are subjected to heating and the depth of shade in any discrete area is determined by the period of time for which it is heated and the temperature reached.

Heating is generally, though not necessarily, effected by a bank of pixels, over which the receiver and transfer sheet are passed together. Each pixel can be separately heated to 300° C. to 400° C., in less than 20 msec and preferably less than 10 msec, usually by an electric pulse in response to a pattern information signal. During the heating period the temperature of a pixel will rise from about 70° C. to 300°-400° C. over about 5-8 msec. With increase in temperature and time more dye will diffuse from the transfer to the receiver sheet and thus the amount of dye transferred onto, and the depth of shade at, any discrete area on the receiver sheet will depend on the period for which a pixel is heated while it is in contact with the reverse side of the transfer sheet.

As heat is applied through indiviually energised pixels for very short periods of time, conditions are adiabatic, the process is selective in terms of location and quantity of dye transferred and the transferred dye remains close to the surface of the receiver sheet.

It is clear that there are significant distinctions between TTP onto synthetic textile materials and DDTTP onto smooth polymeric surfaces and thus dyes which are suitable for the former process are not necessarily suitable for the latter.

In DDTTP it is important that the surfaces of the transfer sheet and receiver sheet are even so that good contact can be achieved between the printed surface of the transfer sheet and the receiving surface of the receiver sheet over the entire printing area because it is believed that the dye is transferred substantially by diffusion. Thus, any defect or speck of dust which prevents good contact over any part of the printing area will inhibit transfer and produce an unprinted portion on the receiver sheet which can be considerably larger than the area of the speck or defect. The receiving surfaces of the substrate of the transfer and receiver sheets are usually a smooth polymeric film, especially of a polyester, which has some affinity for the dye.

Important criteria in the selection of a dye or dye mixture for DDTTP are its thermal properties, fastness properties, such as light fastness, and facility for application to the substrate in the preparation of the transfer sheet. After transfer the dye or dye mixture should preferably not migrate or crystallise and have excellent fastness to light, heat, rubbing, especially rubbing with a oily or greasy object, e.g. a human finger, such as would be encountered in normal handling of the printed receiver sheet. Full colour DDTTP is generally an additive trichromatic process and therefore brightness of shade is important in order to achieve as wide a range of colours from the three shades of yellow, magenta and cyan. However it can be difficult to obtain a neutral black colour from the three components of the trichromat.

As the dye or dye mixture should be sufficiently mobile to migrate from the transfer sheet to the receiver sheet at the temperatures employed, 100°-400° C., in the short time-scale, generally <20 msec, it is preferably free from ionic and water-solubilising groups, and is thus not readily soluble in aqueous or water-miscible media, such as water and ethanol. Many potentially suitable dyes are also not readily soluble in the solvents which are commonly used in, and thus acceptable to, the printing industry; for example, alcohols such as i-propanol, ketones such as methyl ethyl ketone (MEK), methyl n-butyl ketone (MIBK) and cyclohexanone, ethers such as tetrahydrofuran and aromatic hydrocarbons such as toluene. Although the dye can be applied as a dispersion in a suitable solvent such as water or any of the solvents described above, it has been found that brighter, glossier and smoother final prints can be achieved on the receiver sheet if the dye or dye mixture is applied to the substrate from a solution. In order to achieve the potential for a deep shade on the receiver sheet it is desirable that the dye or dye mixture should be readily soluble in the ink medium. It is also important that a dye or dye mixture which has been applied to a transfer sheet from a solution should be resistant to crystallisation so that it remains as an amorphous layer on the transfer sheet for a considerable time. Crystallisation not only produces defects which prevent good contact between the transfer receiver sheet but gives rise to uneven prints.

The following combination of properties is highly desirable for a dye or dye mixture which is to be used in DDTTP:

- High tinctorial strength.
- Correct thermochemical properties (high thermal stability and efficient transferability with heat).
- High optical densities on printing.
- Good solubility in solvents acceptable to printing industry: this is desirable to produce solution coated dyesheets.
- Stable dyesheets (resistant to dye migration or crystallisation).
- Stable printed images on the receiver sheet (resistant to heat, migration, crystallisation, grease, rubbing and light).

The achievement of good light fastness in DDTTP is extremely difficult because of the unfavourable environment of the dye, close to the surface of the polyester receiver sheet. Many known dyes for polyester fibre with high light fastness (<6 on the International Scale of 1-8) on polyester fibre when applied by TTP when penetration into the fibres is good, exhibit very poor light fastness on a polyester receiver sheet when applied by DDTTP.

It has now been found that certain mixtures of yellow, magenta and cyan dyes give neutral black prints, where a true grey-scale of coloration is obtained, and which have good storage stability and good grease resistance.

THE INVENTION

According to a first aspect of the invention, there is provided a thermal transfer printing sheet comprising a substrate having a coating comprising a black dye mixture comprising 5-60% of a dye of Formula 1, 5-60% of a dye of Formula 2, 5-60% of a dye of Formula 3 and/or 1-60% of a dye of Formula 4.

Dyes of Formula 1 are represented as:

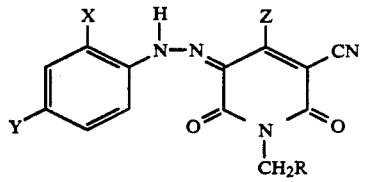

Formula 1 wherein:

X represents —H; nitro or —COOR[1] in which R[1] is an optionally substituted hydrocarbyl radical;

Y represents optionally substituted $C_{1-10}$-alkyl; optionally substituted $C_{1-10}$-alkoxy or halogen;

Z represents an alkyl radical, and

R represents an alkyl radical which may be interrupted by one or two —O— or —COO— links.

Dyes of Formula 2 are represented as:

$$A—N=N—E \qquad \text{Formula 2}$$

wherein:

A is the residue of a dizotisable heteroaromatic amine, A—$NH_2$, in which A is selected from imidazolyl, pyrazolyl, thiazolyl, benzothiazolyl, isothiazolyl, benzoisothiazolyl, pyridoisothiazolyl, thienyl, triazolyl; and E is the residue of an aromatic coupling component, E-B, wherein B is a group displaceable by a diazotised aromatic amine and E is optionally substituted aminophenyl, tetrahydroquinolinyl, julolidyl or aminoquinolinyl.

Dyes of Formula 3 are represented as:

$$C—N=N—D—N=N—G \qquad \text{Formula 3}$$

wherein:

C is the residue of a diazotisable phenylamine or naphthylamine, C—$NH_2$, carrying not more than one unsaturated electron-withdrawing group;

D is an optionally substituted thiophen-2,5-ylene or thiazol-2,5-ylene group; and G is the residue of an aromatic coupling component G-J wherein J is a group displaceable by a diazotised aromatic amine.

Dyes of Formula 4 are represented as:

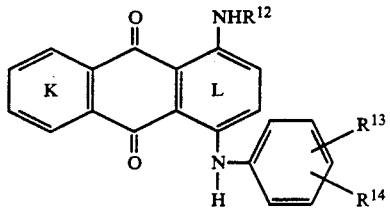

Formula 4 wherein:

$R^{12}$ is $C_{1-6}$-alkyl, $C_{4-8}$-cycloalkyl or $C_{2-6}$-alkenyl;

$R^{13}$ is $C_{1-6}$-alkyl or $C_{2-6}$-alkenyl; and $R^{14}$ is H or $C_{1-6}$-alkyl or $C_{2-6}$-alkenyl.

Specific examples of suitable dyes of Formula 1 are shown in Table 1.

TABLE 1

| Dye | Y | X | Z | R |
|---|---|---|---|---|
| 1 | Cl | H | $CH_3$ | n-$C_3H_7$ |
| 2 | $CH_3$ | $NO_2$ | $CH_3$ | $CH_3$ |
| 3 | $CH_3$ | $NO_2$ | $CH_3$ | n-$C_3H_7$ |
| 4 | $CH_3$ | $NO_2$ | n-$C_3H_7$ | n-$C_3H_7$ |
| 5 | $CH_3$ | $NO_2$ | $CH_3$ | $CH_2OC_2H_5$ |
| 6 | $CH_3$ | $NO_2$ | $CH_3$ | n-$C_7H_{15}$ |
| 7 | $CH_3$ | $NO_2$ | $CH_3$ | n-$C_{11}H_{23}$ |
| 8 | n-$C_3H_7$ | $NO_2$ | $CH_3$ | n-$C_3H_7$ |
| 9 | n-$C_4H_9$ | $NO_2$ | $CH_3$ | $CH_3$ |
| 10 | n-$C_4H_9$ | $NO_2$ | n-$C_3H_7$ | n-$C_3H_7$ |
| 11 | t-$C_4H_9$ | $NO_2$ | $CH_3$ | n-$C_3H_7$ |
| 12 | t-$C_4H_9$ | $NO_2$ | n-$C_3H_7$ | n-$C_3H_7$ |
| 13 | t-$C_4H_9$ | $NO_2$ | $CH_3$ | n-$C_5H_{11}$ |
| 14 | n-$C_9H_{19}$ | $NO_2$ | $CH_3$ | $CH_3$ |
| 15 | n-$C_9H_{19}$ | $NO_2$ | $CH_3$ | n-$C_5H_{11}$ |
| 16 | $CH_3$ | $CO_2C_2H_5$ | $CH_3$ | n-$C_3H_7$ |

In the dyes of Formula 2 the residue, A, of the heteroaromatic amine, A—$NH_2$, may be substituted by one or more non-ionic groups, preferably those which are free from acidic hydrogen atoms unless these are positioned so that they form intramolecular hydrogen bonds. Examples of suitable sustitutents are hydrogen; cyano; thiocyano; nitro; halo, such as fluoro, chloro and bromo; amino; aryl; optionally substituted aryl; $C_{1-4}$-alkylamino; $C_{1-4}$alkyl; $C_{1-4}$-alkoxy; $C_{1-4}$-alkoxy-$C_{1-4}$-alkyl; cyano-$C_{1-4}$-alkyl; formyl (—CHO); $C_{1-4}$- alkylthio; $C_{1-4}$-alkylsulphonyl; trifluoromethyl; mono-($C_{1-4}$-alkyl)amino-carbonyl; di-($C_{1-4}$-alkyl)aminocarbonyl; mono-($C_{1-4}$-alkyl)amino-sulphonyl; di-($C_{1-4}$-alkyl-)aminosulphonyl; amino-, fluoro- and chloro-sulphonyl and carbonyl; $C_{1-4}$-alkoxycarbonyl and $C_{1-4}$-alkyl- carbonyl. Especially preferred substituents are cyano, thiocyano, cyanomethyl, nitro, methyl and carbonylamino.

Examples of heteroaromatic residues represented by A in dyes of Formula 2 are:

4,5-dicyano-imidazol-2-yl
1-ethyl-4,5-dicyano-imidazol-2-yl
1-cyanomethyl-4,5-dicyano-imidazol-2-yl
1-ethyl-3,4-dicyano-pyrazol-5-yl
3-cyanomethyl-4-cyano-pyrazol-5-yl
1-cyanomethyl-3,4-dicyano-pyrazol-5-yl
1,3-di(cyanomethyl)-4-cyano-pyrazol-5-yl
5-nitro-thiazol-2-yl
6-nitro-benzothiazol-2-yl
6-chloro-benzothiazol-2-yl
6-methoxy-benzothiazol-2-yl
4,6-dibromo-benzothiazol-2-yl
6-thiocyano-benzothiazol-2-yl
6-fluorosulphonyl-benzothiazol-2-yl
6-methylsulphonyl-benzothiazol-2-yl
5,6- & 6,7-dichloro-benzothiazol-2-yl
4-cyano-isothiazol-5-yl
3-methyl-4-cyano-isothiazol-5-yl
5-nitro-2,1-benzoisothiazol-3-yl
5-nitro-7-bromo-2,1-benzoisothiazol-3-yl
pyrido[2,3-c]isothiazol-3-yl
6-cyano-pyrido[2,3-c]isothiazol-3-yl
6-nitro-pyrido[2,3-c]isothiazol-3-yl
5-methyl-6-cyano-pyrido[2,3-c]isothiazol-3-yl
5-methoxy-6-cyano-pyrido[2,3-c]isothiazol-1-yl
3,5-dinitro-thien-2-yl
3,5-dicyano-thien-2-yl
3-cyano-5-nitro-thien-2-yl
3-formyl-5-nitro-thien-2-yl
3-carboxy-5-nitro-thien-2-yl
1-benzyl-4-cyano-1,2,3-triazol-5-yl
1-benzyl-4-amido-1,2,3-triazol-5-yl.

Especially preferred residues represented by A are:

1-cyanomethyl-3,4-dicyanopyrazol-5-yl;
4-cyanoisothiazol-5-yl;
3-methyl-4-cyano-isothiazol-5-yl;
pyrido[2,3-c]isothiazol-3-yl, optionally substituted in the 5 and/or 6 positions by a group selected from cyano, nitro, methyl and methoxy; and thien-2-yl, substituted in the 3 & 5 positions by a one or more groups selected from cyano, nitro, methylaminocarbonyl and optionally substituted in the 4 position by methyl or methoxy.

In the dyes of Formula 2 the coupler is preferably of the formula, E-B in which the displaceable group, B, is hydrogen. E is preferably selected from optionally substituted 4-aminophenyl, 8-aminoquinolin-5-yl and 1,2,3,4-tetrahydroquinolin-6-yl.

Examples of optional ring substituents are $C_{1-4}$-alkyl; $C_{1-4}$-alkoxy; $C_{1-4}$-alkylaminocarbonyl; $C_{1-4}$-alkylcarbonylamino; halo, such as bromo and chloro; $C_{1-4}$-alkylcarbonyloxy-$C_{1-4}$-alkyl; $C_{1-4}$-alkoxy-$C_{1-4}$-alkyl; cyano-$C_{1-4}$-alkyl; cyano; $C_{1-4}$-alkylcarbonyl; $C_{1-4}$-alkoxycarbonyl and $C_{1-4}$-alkylaminosulphonyl; especially $C_{1-4}$-alkyl, $C_{1-4}$-alkylcarbonylamino and chloro. Examples of substituents for the amino group on the coupling component are $C_{1-6}$-alkyl; phenyl; and substituted $C_{1-4}$-alkyl in which the substituents are selected from cyano, hydroxy, chloro, $C_{1-4}$-alkyl-carbonyloxy, $C_{1-4}$-alkoxy, phenyl, $C_{1-4}$-alkoxycarbonyl & succinamido.

It is preferred that E in dyes of Formula 2 has the Formula 5:

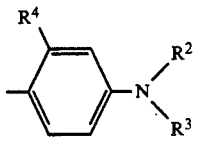

Formula 5 wherein:

$R^4$ is selected from H, chloro, $C_{1-4}$-alkyl, $C_{1-4}$-alkylcarbonylamino; and $R^2$ & $R^3$ are selected from H; $C_{1-4}$-alkyl and $C_{1-4}$-alkyl substituted by a group selected from $C_{1-4}$-alkoxy, $C_{1-4}$-alkoxycarbonyl, $C_{1-4}$-alkylcarbonyloxy, cyano and chloro.

It is more especially preferred that in Formula 2, $R^4$ is selected from H, chloro, methyl or acetylamino and $R^2$ & $R^3$ are selected from $C_{2-4}$-alkyl, especially ethyl and n-butyl; $C_{1-4}$-alkoxy-$C_{1-4}$-alkyl, especially ethoxyethyl; $C_{1-4}$-alkoxycarbonyl-$C_{1-4}$-alkyl, especially 2-(methoxycarbonyl)ethyl and 2-(ethoxycarbonyl)ethyl; $C_{1-4}$-alkylcarbonyloxy-$C_{1-4}$-alkyl, especially 2-acetoxyethyl and 2-cyanoethyl.

Examples of coupling components represented by E-H in dyes of Formula 2 are:

3-methylaniline
N,N-dimethyl- & N,N-diethyl-aniline
3-methyl-N,N-diethylaniline
3-chloro-N,N-diethylaniline
3-methoxy-N,N-diethylaniline
N-ethyl-N-(2-ethoxyethyl)aniline
3-methyl-N,N-di(n-propyl)aniline
3-acetylamino-N,N-diethylaniline
3-methyl-N-benzyl-N-ethylaniline
3-methyl-N-n-butyl-N-ethylaniline
N-phenyl-N-(2-acetoxyethyl)aniline
3-methyl-N-sec-butyl-N-ethylaniline
N-ethyl-N-(2-succinamidoethyl)aniline
3-acetylamino-N-ethyl-N-n-butylaniline
3-methyl-N,N-di(2-acetoxyethyl)aniline
3-methyl-N-ethyl-N-[cyanoethyl]aniline
3-methyl-N-ethyl-N-(2-acetoxyethyl)aniline
N-methyl-N-(methoxycarbonylethyl)aniline
3-benzoylamino-N,N-di(acetoxyethyl)aniline
3-acetylamino-6-methoxy-N,N-diethylaniline
3,6-dimethoxy-N-(1,2-dimethyl-n-propyl)aniline
3-methyl-N-n-butyl-N-(2-ethoxycarbonylethyl)aniline
3-methyl-N-n-butyl-N-[2-(ethoxycarbonyl)ethyl]aniline
3-methyl-N-n-butyl-N-[3-(ethoxycarbonyl)propyl]aniline
3-methyl-N-ethyl-N-(2-hydroxy-3-chloro-n-propyl)aniline
3-methyl-N-n-butyl-N-(3-methoxycarbonyl-n-propyl-)aniline julolidine
1-acetoxyethyl-2,2,4,7-tetramethyl-1,2,3,4-tetrahydroquinoline.

A preferred dye of Formula 2 conforms to the Formula 6:

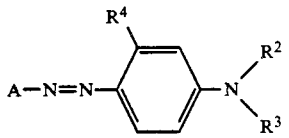

Formula 6 wherein:

A is selected from:

4-cyanoisothiazol-5-yl;

3-methyl-4-cyanoisothiazol-5-yl;

1-cyanomethyl-3,4-dicyanopyrazol-5-yl; pyrido[2,3-c]isothiazol-3-yl, optionally substituted in the 5 and/or 6 positions by a group selected from cyano, nitro, methyl and methoxy; and thien-2-yl, substituted in the 3 & 5 positions by a group selected from cyano, nitro, methylaminocarbonyl and optionally substituted in the 4 position by methyl or methoxy;

$R^4$ is selected from H, $C_{1-4}$-alkyl, $C_{1-4}$-alkylcarbonylamino; and $R^2$ & $R^3$ are selected from H; $C_{1-4}$-alkyl and $C_{1-4}$-alkyl substituted by a group selected from $C_{1-4}$-alkoxy, $C_{1-4}$-alkoxycarbonyl, $C_{1-4}$-alkylcarbonyloxy, cyano and chloro.

In an especially preferred dye of Formula 6:

A is selected from 4-cyanoisothiazol-5-yl, 3-methyl-4-cyanoisothiazol-5- and 1-cyanomethyl-3,4-dicyanopyrazol-5-yl;

$R^4$ is selected from H, methyl and acetylamino; and $R^2$ & $R^3$ are selected from $C_{2-4}$-alkyl, especially ethyl and n-butyl; $C_{1-4}$-alkoxy-$C_{1-4}$-alkyl, especially ethoxyethyl; $C_{1-4}$-alkoxycarbonyl-$C_{1-4}$-alkyl, especially 2 (methoxycarbonyl) & 2-(ethoxycarbonyl) ethyl; $C_{1-4}$-alkylcarbonyloxy-$C_{1-4}$-alkyl, especially 2-acetoxyethyl; and 2-cyanoethyl.

Examples of suitable dyes of Formula 2 are represented by the Formula 7 and are shown in Table 2.

TABLE 2

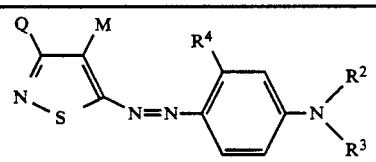

Formula 7

| Dye | Q | M | $R^2$ | $R^3$ | $R^4$ |
|---|---|---|---|---|---|
| 17 | $CH_3$ | CN | $C_2H_5$ | $C_2H_4OCOCH_3$ | $CH_3$ |
| 18 | $CN_3$ | CN | $C_2H_4OCOCH_3$ | $C_2H_4OCOCH_3$ | $CH_3$ |

Further examples of suitable dyes of Formula 2 are:

3-methyl-4-(3-cyanomethyl-4,5-dicyanoimidazol-2-ylazo)-N-n-butyl-N-(3-[methoxycarbonyl]-propyl)-aniline 3-methyl-4-(1-cyanomethyl-3,4-dicyanopyrazol-5-ylazo)-N-n-butyl-N-2-(ethoxycarbonyl)ethylaniline 3-methyl-4-(1-cyanomethyl-3,4-dicyanopyrazol-5-ylazo)-N-n-butyl-N-ethylaniline 3-acetylamino-4-(1-cyanomethyl-3,4-dicyanopyrazol-5-ylazo)-N-n-butyl-N-ethylaniline 3-methyl-4-(1-cyanomethyl-3,4-dicyanopyrazol-5-ylazo)-N,N-diethylaniline 3-methyl-4-(6-thiocyanobenzothiazol-2-ylazo)-N,N-diethylaniline, 3-methyl-4-(6-thiocyanobenzothiazol-2-ylazo)-N,N-di(2-acetoxyethyl)aniline, 3-methyl-4-(6-thiocyanobenzothiazol-2-ylazo)-N-ethyl-N-sec-butylaniline 3-methyl-4-(3-methyl-4-cyanoisothiazol-5-ylazo)-N,N-diethyl-aniline 4-(3-methyl-4-cyanoisothiazol-5-ylazo)-N,N-diethylaniline 4-(3-methyl-4-cyanoisothiazol-5-ylazo)-N-ethyl-N-(2-ethoxyethyl)aniline 3-methyl-4-(3-methyl-4-cyanoisothiazol-5-ylazo)-N,N-di(2-acetoxyethyl)aniline 3-methyl-4-(3-methyl-4-cyanoisothiazol-5-ylazo)-N-n-butyl-N-(2-[ethoxy-carbonyl]ethyl)aniline 3-methyl-4-(3-methyl-4-cyanoisothiazol-5-ylazo)-N-ethyl-N-(2-[ethoxycarbonyl]ethyl)aniline 3-methyl-4-(3-methyl-4-cyanoisothiazol-5-ylazo)-N-ethyl-N-(2-ethoxyethyl)aniline 3-methyl-4-(5-nitrobenzoisothiazol-3-ylazo)-N,N-diethylaniline 3-methyl-4-(5-cyano-6-methylpyridoisothiazol-3-ylazo)-N,N-di(n-propyl)aniline 3-methyl-4-(5-nitropyridoisothiazol-3-yl-azo)-N,N-diethylaniline 3-methyl-4-(3,5-dinitrothien-2-ylazo)-N,N-diethylaniline.

In the dyes of Formula 3, the residue, C, of the amine, C—$NH_2$, is preferably a phenyl group which may be unsubstituted or substituted by nonionic groups, preferably those which are free from acidic hydrogen atoms unless these are positioned so that they form intramolecular hydrogen bonds. By the term unsaturated electron-withdrawing group is meant a group of at least two atoms containing at least one multiple (double or triple) bond and in which at least one of the atoms is more electronegative than carbon. Examples of preferred unsaturated electron-withdrawing groups are —CN; —SCN; —$NO_2$; —$CONT_2$; —$SO_2NT_2$; —$COT^1$; —$SO_2T^1$; —$COOT^2$; —$SO_2OT^2$; —COF; —COCl; —$SO_2F$ and —$SO_2Cl$, wherein each T is independently H, $C_{1-4}$-alkyl or phenyl, $T^1$ is $C_{1-4}$-alkyl or phenyl and $T^2$ is $C_{1-4}$-alkyl.

Examples of other suitable substituents which may be carried by C in place of, or in addition to, the unsaturated electron-withdrawing group are $C_{1-4}$-alkyl, $C_{1-4}$-alkoxy, $C_{1-4}$-alkoxy-$C_{1-4}$-alkyl; $C_{1-4}$-alkoxy-$C_{1-4}$-alkoxy; —$NT_2$ wherein T is as hereinbefore described; halogen, especially Cl, Br & F; $CF_3$; cyano-$C_{1-4}$-alkyl and $C_{1-4}$-alkylthio.

It is preferred that C in dyes of Formula 3 is of the Formula 8:

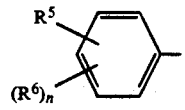

Formula 8 wherein:

$R^5$ is selected from —H, —CN, —SCN; —$NO_2$; —$CONT_2$; —$SO_2NT_2$; —$COT^1$; —$SO_2T^1$; —$COOT^2$; —$SO_2OT^2$; —COF; —COCl; —$SO_2F$, and —$SO_2Cl$;

each $R^6$ is independently selected from H; $C_{1-4}$-alkyl; $C_{1-4}$-alkoxy; —F; —Cl; —Br; —$CF_3$ and —$NT_2$;

wherein T, $T^1$ and $T^2$ are as hereinbefore described; and n is 1, 2 or 3.

Examples of phenyl and naphthyl groups represented by C in dyes of Formula 3 are phenyl, 2-chlorophenyl. 4-chlorophenyl, 2,4-dichlorophenyl, 2-trifluoromethyl- 4-chlorophenyl, 3,4-dichlorophenyl, 2-bromophenyl, 2-nitrophenyl, 4-nitrophenyl, 2-cyanophenyl, 3-cyanophenyl, 4-cyanophenyl, 2-trifluoromethylphenyl, 4-(methoxycarbonyl)phenyl, 4-(ethoxycarbonyl)phenyl, 4-methylphenyl, 3-methylphenyl, 4-(methylsulphonyl)phenyl, 4-thiocyanophenyl, 2-chloro-4-nitrophenyl and 1-naphthyl.

The optionally substituted thiophen-2,5-ylene or thiazol-2,5-yl group, D, in dyes of Formula 3 is preferably derived from a 2-amino- thiophene or 2-aminothiazole having a hydrogen atom or a group displaceable by a diazotised amine in the 5-position and optionally other non-ionic substituents present in the 3 and/or 4 positions. Examples of suitable substituents for the 3 and 4 positions are those given above for C. Especially preferred substituents for the 4-position are $C_{1-4}$-alkyl; $C_{1-4}$-alkoxy; aryl, especially phenyl and $NO_2$-phenyl; $C_{1-4}$-alkoxy—CO; $C_{1-4}$alkoxy—$C_{1-4}$-alkoxy—CO— and halogen. Especially preferred substituents for the 3-position of the thiophen-2,5-ylene group are CN; $NO_2$; —$CONT_2$; —$SO_2NT_2$; —$COT^1$ and —$SO_2T^1$ and those given above for the 4-position, wherein T and $T^1$ are as hereinbefore described.

It is preferred that D in dyes of Formula 3 is a group of the Formula 9:

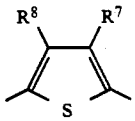

Formula 9 wherein:

$R^7$ is selected from —CN, —$COOT^1$, —$COT^1$ and —$CONT_2$; wherein T and $T^1$ are as hereinbefore described; and $R^8$ is —H or $C_{1-4}$-alkyl.

It is especially preferred that $R^7$ is —CN: acetyl: methoxycarbonyl; ethoxycarbonyl or dimethylaminocarbonyl and $R^8$ is —H or methyl.

Examples of suitable 2-aminothiophenes and 2-aminothiazoles are:

2-amino-3-cyanothiophene
2-amino-3-cyano-4-methylthiophene
2-amino-3-acetylthiophene
2-amino-3-(ethoxycarbonyl)thiophene
2-amino-3-(aminocarbonyl)thiophene
2-amino-3-(dimethylaminocarbonyl)thiophene
2-aminothiazole
2-amino-4-methylthiazole In dyes of Formula 3 the coupling component is preferably of the formula, G-J, in which J is a displaceable hydrogen atom. It is further preferred that the coupling component is an optionally substituted aniline, naphthylamine, diaminopyridine, aminoheteroaromatic, such as tetrahydroquinoline and julolidine, or hydroxypyridone. Especially preferred coupling components are optionally substituted anilines and tetrahydroquinolines. Examples of suitable substituents for the rings of these systems are $C_{1-4}$-alkyl, $C_{1-4}$-alkoxy; $C_{1-4}$-alkyl- & phenyl—NH—CO—; $C_{1-4}$alkyl-CONH—; phenyl—CO—NH—; halogen, especially Cl & Br; $C_{1-4}$-alkyl—CO—O—$C_{1-4}$-alkyl; $C_{1-4}$-alkoxy—$C_{1-4}$-alkyl and cyano-$C_{1-4}$-alkyl It is preferred that G is a 4-aminophenyl group preferably having one or two optionally substituted $C_{1-4}$-alkyl groups attached to the amino group and optionally carrying one ring substituent in the 3-position or two ring substituents in the 2 and 5 positions with respect to the amino group. Preferred ring substituents are $C_{1-4}$-alkyl, especially methyl; $C_{1-4}$-alkoxy. especially methoxy or ethoxy and $C_{1-4}$-alkyl—CONH—, especially acetylamino. Preferred substituents for the amino group are independently selected from $C_{1-4}$-alkyl, especially ethyl and/or butyl; aryl, especially phenyl; $C_{4-8}$-cycloalkyl; and $C_{1-4}$-alkyl substituted by a group selected from —OH; —CN; halogen, especially F, Cl or Br; aryl, especially phenyl; $C_{1-4}$-alkoxy-$C_{1-4}$-alkoxy; $C_{1-4}$-alkoxy, $C_{1-4}$-alkyl—CO—, $C_{1-4}$-alkoxy—CO—, $C_{1-4}$-alkyl—COO—, $C_{1-4}$-alkoxy—O—$C_{1-4}$-alkoxy—CO— and $C_{1-4}$-alkoxy—COO—.

It is especially preferred that G in dyes of Formula 3 is a group of the Formula 10:

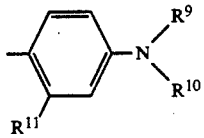

Formula 10 wherein $R^9$ & $R^{10}$ are independently selected from —H; $C_{1-4}$-alkyl, aryl, $C_{4-8}$-cycloalkyl and $C_{1-4}$-alkyl substituted by a group selected from —OH, —CN, haloqen, aryl, $C_{1-4}$-alkoxy, $C_{1-4}$-alkoxy—$C_{1-4}$-alkoxy, $C_{1-4}$-alkyl—CO—, $C_{1-4}$-alkoxy—CO—, $C_{1-4}$-alkyl—COO—, $C_{1-4}$-alkoxy—$C_{1-4}$-alkoxy—CO—, and $C_{1-4}$-alkoxy-COO-; and $R^{11}$ is selected from H, $C_{1-4}$-alkyl, $C_{1-4}$-alkoxy and —$NHCOT^1$ wherein $T^1$ is as hereinbefore described.

The aryl group represented by, or contained in, $R^9$ and/or $R^{10}$ is preferably phenyl or substituted phenyl, examples of suitable substituents being those given above for C.

It is preferred that $R^9$ and $R^{10}$ are $C_{2-4}$-alkyl which may be the same or different and, more especially, that $R^9$ is ethyl and $R^{10}$ is n-propyl or n-butyl, or that $R^9$ and $R^{10}$ are both ethyl or both n-propyl or both n-butyl. It is also preferred that $R^{11}$ is H, methyl or, more especially, acetylamino.

Examples of coupling components represented by G-H are:

N,N-diethylaniline
N-n-butyl-N-ethylaniline
3-methyl-N,N-diethylaniline
3-methyl-N,N-di(2-acetoxyethyl)aniline
3-methyl-N-ethyl-N-benzylaniline
3-methyl-N-n-butyl-N-2-(ethoxycarbonyl)ethylaniline
3-methyl-N-n-butyl-N-[3-(ethoxycarbonyl)propyl]aniline
3-methyl-N,N-di(n-propyl)aniline
3-methyl-N-n-butyl-N-ethylaniline
3-methoxy-N,N-diethylaniline
3-methoxy-N,N-di(2-[ethoxycarbonyl]ethyl)aniline
3-acetylamino-N,N-diethylaniline
3-acetylamino-N,N-di(n-butyl)aniline
3-acetylamino-N-ethyl-N-(n-butyl)aniline
N,N-di(2-acetoxyethyl)aniline
N,N-di(2-cyanoethyl)aniline
N-ethyl-N-cyanoethylaniline.

A preferred sub-class of dyes according to Formula 3 conform to the Formula 11:

Formula 11

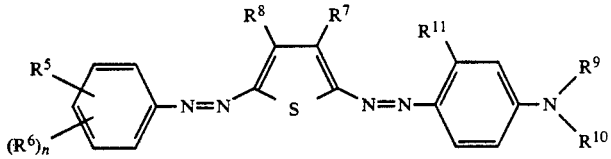

wherein:

$R^5$ is selected from —H; —CN; —$NO_2$; —$CONT_2$; —$SO_2NT_2$; —$COT^1$; —$SO_2T^1$; —$COOT^2$ and —$SO_2OT^2$;

each $R^6$ is independently selected from H; halogen, especially F, Cl or —Br; —$CF_3$; $C_{1-4}$-alkyl; $C_{1-4}$-alkoxy; and —$NT_2$;

n is 1, 2 or 3;

$R^7$ is selected from —CN, —$COT^1$, —$CONT_2$ and —$COOT^1$;

$R^8$is —H or $C_{1-4}$-alkyl;

$R^9$ & $R^{10}$ are independently selected from -H, $C_{1-4}$-alkyl, phenyl, $C_{4-8}$-cycloalkyl and $C_{1-4}$-alkyl substituted by a group selected from —OH, —CN, $C_{1-4}$-alkoxy, $C_{1-4}$-alkoxy—$C_{1-4}$-alkoxy, $C_{1-4}$-alkyl—CO—, $C_{1-4}$-alkoxy—CO—, $C_{1-4}$-alkyl—COO—, halogen, $C_{1-4}$-alkoxy-$C_{1-4}$-alkoxy—CO—, $C_{1-4}$-alkoxy—COO— and phenyl; and $R^{11}$ is selected from —H, $C_{1-4}$-alkyl, $C_{1-4}$-alkoxy and —$NHCOT^1$ wherein T, $T^1$ and $T^2$ are as hereinbefore described.

When there are two substituents selected from $R^5$ & $R^6$ these are preferably in the 2 & 4 or 3 & 4 positions and where there are three substituents selected from $R^5$ & $R^6$ these are preferably in the 2, 4 & 6 positions.

In an especially preferred class of dye within Formula 11, $R^5$ is selected from —H, —CN, $C_{1-4}$-alkyl—$SO_2$— & $C_{1-4}$-alkoxy—CO—; $R^6$ is selected from —H, —Cl, —Br, —$CF_3$, $C_{1-4}$-alkyl; $R^7$ is —CN; $R^8$ is —H or methyl; $R^{11}$ is $C_{1-4}$-alkyl—CONH—; $R^9$ is ethyl; $R^{10}$ is ethyl; and n=1.

Another preferred class of dye within Formula 11 is that in which $R^5$ & $R^8$ are —H, n is 2 and each $R^6$ is independently selected from —H; halogen, especially —F, —Cl, or —Br; $C_{1-4}$-alkyl; $C_{1-4}$alkoxy and —$CF_3$.

A further preferred sub-class of dyes according to Formula 3 conform to the Formula 12:

Formula 12

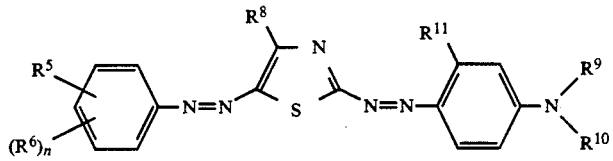

wherein:

$R^5$ is selected from —H; —CN; —$NO_2$; —$CONT_2$; —$SO_2NT_2$; —$COT^1$; —$SO_2T^1$; —$COOT^2$ and —$SO_2OT^2$;

$R^6$ is selected from —H; halogen; —$CF_3$; $C_{1-4}$-alkyl; $C_{1-4}$-alkoxy; and —$NT_2$;

n is 1, 2 or 3;

$R^8$ is —H or $C_{1-4}$-alkyl;

$R^9$ & $R^{10}$ are independently selected from —H, $C_{1-4}$-alkyl, phenyl, $C_{4-8}$-cycloalkyl and $C_{1-4}$-alkyl substituted by a group selected from —OH, —CN, $C_{1-4}$—alkoxy, $C_{1-4}$—alkoxy—$C_{1-4}$—alkoxy, $C_{1-4}$—alkyl—CO—, $C_{1-4}$—alkoxy—CO—, $C_{1-4}$—alkyl—COO—, halogen, $C_{1-4}$-alkoxy-$C_{1-4}$-alkoxy-CO—, $C_{1-4}$-alkoxy—COO— and phenyl; and $R^{11}$ is selected from H, $C_{1-4}$-alkyl, $C_{1-4}$-alkoxy and —$NHCOT^1$ wherein T, $T^1$ and $T^2$ are as hereinbefore described.

Preferred dyes of Formula 12 are those in which $R^5$ & $R^6$ are H, $R^8$ is —H or methyl, $R^9$ & $R^{10}$ are selected from ethyl, n-propyl and n-butyl and $R^{11}$ is —H, methyl or acetylamino.

Examples of specific dyes according to Formula 11 are shown in Table 3.

TABLE 3

| Dye | $R^5$ | $R^6$ | $R^7$ | $R^8$ | $R^9$ | $R^{10}$ | $R^{11}$ |
|---|---|---|---|---|---|---|---|
| 19 | H | H | CN | H | $C_2H_5$ | $C_2H_5$ | $NHOCH_3$ |
| 20 | H | H | CN | H | n-$C_4H_9$ | n-$C_4H_9$ | $NHCOCH_3$ |
| 21 | H | H | CN | H | $C_2H_5$ | n-$C_4H_9$ | $NHCOCH_3$ |
| 22 | 2-CN | H | CN | H | $C_2H_5$ | $C_2H_5$ | $NHCOCH_3$ |
| 23 | 3-CN | H | CN | H | $C_2H_5$ | $C_2H_5$ | $NHCOCH_3$ |
| 24 | H | H | CN | H | $C_2H_4OCOCH_3$ | $C_2H_4OCOCH_3$ | H |
| 25 | H | H | $CON(CH_3)_2$ | H | $C_2H_5$ | $C_2H_5$ | $NHCOCH_3$ |
| 26 | H | H | $CON(CH_3)_2$ | H | $C_2H_5$ | $C_2H_5$ | $CH_3$ |
| 27 | H | H | CN | H | $C_2H_5$ | $C_2H_5$ | $CH_3$ |
| 28 | 2-CN | H | CN | H | $C_2H_5$ | $C_2H_5$ | $CH_3$ |
| 29 | 3-CN | H | CN | H | $C_2H_5$ | $C_2H_5$ | $CH_3$ |
| 30 | H | H | CN | H | $C_2H_5$ | $CH_2C_6H_5$ | $CH_3$ |
| 31 | H | H | CN | H | $C_2H_5$ | $C_2H_4OC_2H_5$ | $CH_3$ |
| 32 | H | 4-Cl | CN | H | $C_2H_5$ | $C_2H_5$ | $NHCOCH_3$ |
| 33 | H | H | $COCH_3$ | H | $C_2H_5$ | $C_2H_5$ | $NHCOCH_3$ |
| 34 | H | H | $COCH_3$ | H | $C_2H_5$ | $C_2H_5$ | $CH_3$ |
| 35 | H | H | $CO_2Et$ | H | $C_2H_5$ | $C_2H_5$ | $NHCOCH_3$ |
| 36 | H | H | $CO_2Et$ | H | $C_2H_5$ | $C_2H_5$ | $CH_3$ |
| 37 | H | H | CN | $CH_3$ | $C_2H_5$ | $C_2H_5$ | $NHCOCH_3$ |
| 38 | H | H | CN | $CH_3$ | $C_2H_5$ | $C_2H_5$ | $CH_3$ |

TABLE 3-continued

| Dye | $R^5$ | $R^6$ | $R^7$ | $R^8$ | $R^9$ | $R^{10}$ | $R^{11}$ |
|---|---|---|---|---|---|---|---|
| 39 | H | H | CN | $CH_3$ | $C_2H_5$ | $C_2H_5$ | H |
| 40 | H | H | CN | $CH_3$ | $C_2H_5$ | n-$C_4H_9$ | $NHCOCH_3$ |
| 41 | H | H | CN | $CH_3$ | $C_2H_5$ | n-$C_4H_9$ | $CH_3$ |
| 42 | H | 3,4-diCl | CN | H | $C_2H_5$ | $C_2H_5$ | $NHCOCH_3$ |
| 43 | H | 4-$CH_3$ | CN | H | $C_2H_5$ | $C_2H_5$ | $NHOCH_3$ |
| 44 | H | 4-$CH_3$ | CN | H | $C_2H_5$ | $C_2H_5$ | $CH_3$ |
| 45 | H | 3-$CH_3$ | CN | H | $C_2H_5$ | $C_2H_5$ | $NHCOCH_3$ |
| 46 | H | H | CN | H | $C_2H_5$ | $C_2H_4CN$ | H |
| 47 | H | 4-Cl | CN | H | $C_2H_5$ | $C_2H_5$ | $CH_3$ |
| 48 | H | H | CN | H | $C_2H_5$ | $C_2H_5$ | H |
| 49 | 4-$NO_2$ | H | CN | H | $C_2H_5$ | $C_2H_4CN$ | H |
| 50 | 4-CN | H | CN | H | $C_2H_5$ | $C_2H_5$ | $NHCOCH_3$ |
| 51 | 2-CN | H | CN | H | $C_2H_5$ | $C_2H_5$ | $NHCOC_2H_5$ |
| 52 | H | H | CN | H | $C_2H_5$ | $C_2H_4COOCH_3$ | H |

Examples of specific dyes according to Formula 12 are shown in Table 4:

TABLE 4

| Dye | $R^5$ | $R^6$ | $R^8$ | $R^9$ | $R^{10}$ | $R^{11}$ |
|---|---|---|---|---|---|---|
| 53 | H | H | H | $C_2H_5$ | $C_2H_5$ | $CH_3$ |
| 54 | H | H | H | $C_2H_5$ | $C_2H_5$ | $NHCOCH_3$ |
| 55 | H | H | $CH_3$ | $C_2H_5$ | $C_2H_5$ | $CH_3$ |
| 56 | H | H | $CH_3$ | $C_2H_5$ | $C_2H_5$ | $NHCOCH_3$ |

In the dyes of Formula 4 it is preferred that the group represented by $R^{12}$ is branched alkyl and more especially $C_{3-5}$-alkyl; an especially preferred species being iso-propyl. Examples of other groups represented by $F^{12}$ are sec-butyl, iso-butyl, t-butyl, allyl, n-propyl, 2-methylbutyl and cyclohexyl. It is preferred that $R^{14}$ is H and that $R^{13}$ is in a para position with respect to the azo bridging group. It is especially preferred that $R^{13}$ is methyl. Examples of other groups represented by $R^{13}$ and $R^{14}$ are ethyl, n-propyl, iso-butyl, t-butyl, n-butyl and n-hexyl.

Rings K and L in the dyes of Formula 4 may be substituted in the remaining positions by non-ionic groups, preferably those which are free from acidic hydrogen atoms unless the latter are positioned so that they form intra-molecular hydrogen bonds. Examples of suitable substituents are halogen, especially bromine and chlorine, alkyl, especially $C_{1-6}$-alkyl, and hydroxy, especially in positions adjacent to the 9,10-carbonyl groups of the anthraquinone nucleus.

Specific examples of preferred dyes of Formula 4 for use in the present invention are shown in Table 5:

TABLE 5

| Dye | $R^{12}$ | $R^{13}$ | $R^{14}$ |
|---|---|---|---|
| 57 | $-CH(CH_3)_2$ | p-$CH_3$ | H |
| 58 | $-CH_3$ | p-$CH_3$ | H |
| 59 | $-CH_3$ | m-$CH_3$ | H |
| 60 | 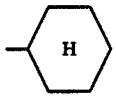 | m-$CH_3$ | H |
| 61 | 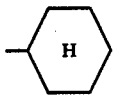 | p-$CH_3$ | H |
| 62 | $-CH_3$ | p-(n-$C_4H_9$) | H |
| 63 | $-CH(CH_3)_2$ | p-(n-$C_4H_9$) | H |
| 64 | $-CH(CH_3)_2$ | p-$CH_3$ | m-$CH_3$ |
| 65 | -n-$C_6H_{13}$ | p-$CH_3$ | H |
| 66 | $-CH(CH_3)CH_2CH_3$ | p-$CH_3$ | H |
| 67 | $-CH_2CH=CH_2$ | p-$CH_3$ | H |

TABLE 5-continued

| Dye | $R^{12}$ | $R^{13}$ | $R^{14}$ |
|---|---|---|---|
| 68 | $-CH_3$ | $CH_2CH=CH_2$ | H |

The Coating

The coating suitably comprises a binder together with a mixture of dyes of Formula 1, Formula 2, Formula 3 and/or Formula 4. The ratio of binder to dye is preferably at least 1:1 and more preferably from 1.5:1 to 4:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye mixtures to the substrate which has acceptable solubility in the ink medium, i.e. the medium in which the dye mixture and binder are applied to the transfer sheet. It is erred however, that the dye mixture is soluble in the binder so that it can exist as a solid solution in the binder on the transfer sheet. In this form it is generally more resistant to migration and crystallisation during storage. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic. Mixtures of two or more of the above resins may also be used. It is also preferred to use a binder which is soluble in one of the above-mentioned commercially acceptable organic solvents. Preferred binders of this type are EHEC, particularly the low and extra-low viscosity grades, and ethyl cellulose.

The Dye Mixtures

This invention allows the manufacture of a TTP sheet coated with black dye mixtures using various proportions of the cyan, magenta and yellow dyes described above.

It has been found that a black image produced with the present mixture in a DDTT process is superior to the "black" image produced in the normal manner by separate application of the yellow, magenta and cyan components of the trichromat. Not only does the use of the mixture avoid problems associated with registration in the separate application of the three components which can be particularly severe in the printing of text, but it avoids a multilayer heterogeneous black image which is susceptible to colour change if the upper layer is damaged or removed by fading or rubbing.

However, the use of a heterogeneous black mixture can pose other problems if the dyes are not carefully matched so that they transfer at the same rate and produce a neutral black shade regardless of the length of the heating pulse.

Where a dye mixture is used it is desirable that all the dyes are matched in the mixture so that they are transferred evenly and rapidly, from the transfer sheet to the receiver sheet.

The important criterion in the selection of a black dye mixture is that even transfer of the black dye produces a true neutral grey-scale of coloration where the depth of shade from pale grey to black obtained in DDTTP is proportional to the heat applied. Whereas, uneven transfer of the dyes in the dye mixture can impart undesirable red, blue or yellow tones to the grey prints.

The neutrality of the grey-scale may be defined numerically using an equation recommended by the Commission Internationale l'Eclairage (CIE) in 1976. This equation, CIELAB, is one of the most reliable for quantifying surface colours. The CIELAB system uses a*, b* chromaticity co-ordinates which are calculated, via tristimulus values, from measured reflectance values. These chromaticity co-ordinates a* and b* can be represented diagrammatically by three axes mutually at right angles as shown below.

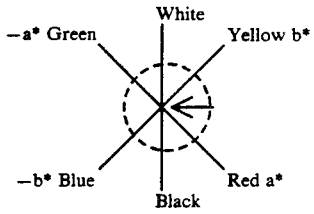

An ideal neutral grey has $a^*=0$ and $b^*=0$ and is found at the point of intersection of the three axes. However, essentially neutral grey shades are found in a cylinder around the black-white axis where $$\sqrt{a^{*2}+b^{*2}} \leqq 5.0$$

and where the reflectance values are measured using illuminant C, which represents average daylight.

In the present invention it is preferred that the dye mixtures have, at each of the heating periods used $\sqrt{a^{*2}+b^{*2}}$ values equal to or less than 5.0, it is especially preferred that $\sqrt{a^{*2}+b^{*2}}$ values are equal to or less than 2.5, it is more especially preferred that $\sqrt{a^{*2}+b^{*2}}$ values are equal to or less than 2.0.

It is preferred that the dye mixtures comprise 5–60% of a dye of Formula 1, 5–60% of a dye of Formula 2, 5–60% of a dye of Formula 3 and 1–40% of a dye of Formula 4. It is especially preferred that the dye mixtures comprise 20–40% of a dye of Formula 1, 20–40% of a dye of Formula 2, 15–45% of a dye of Formula 3 and 5–30% of a dye of Formula 4. It is most especially preferred that the dye mixtures comprise 25–30% of a dye of Formula 1, 25–30% of a dye of Formula 2, 20–40% of a dye of Formula 3 and 5–20% of a dye of Formula 4.

The ratio of dyes of Formula 1 to dyes of Formula 2 to dyes of Formula 3 to dyes of Formula 4 is preferably between 1:1:1:1 and 5:5:5:1 and more preferably between 1.5:1.5:1.5:1 and 4:4.5:5:1.

The ratio of dyes of Formula 3 to dyes of Formula 4 is preferably between 1:1 and 5:1 and more preferably between 1.4:1 and 4.5:1. The combination of cyan dyes of Formula 3 and Formula 4 is desirable and produces a neutral black at low or high print times. If for example a dye of Formula 3 is used alone reddish-blacks are obtained at low print times and bluish-blacks are obtained at high print times. Strong images with good light fastness and good resistance to finger grease are obtained with combinations of the cyan dyes described above.

Applications where blue, yellow and red dyes are mixed to produce blacks is well known. These mixtures comprise largely navy and yellow-brown dyes, which are dull and cheap to make and produce blacks which are adjusted to the required shades by adding minor amounts of red or yellow dyes. It is, in dyeing, unusual and expensive to use a mixture of bright cyan, magenta and yellow dyes to produce blacks, particularly in the more even amounts which are desirable in DDTTP.

The dye mixtures as hereinbefore defined have particularly good thermal properties giving rise to even prints on the receiver sheet, whose depth of shade is accurately proportional to the quantity of applied heat so that a true grey scale of coloration can be attained.

The dye mixtures as hereinbefore defined also have strong coloristic properties and good solubility in a wide range of solvents, especially those solvents which are widely used and accepted in the printing industry, for example, alkanols, such as i-propanol and butanol; aromatic hydrocarbons, such as toluene, ethers such as tetrahydrofuran (THF) and ketones such as MEK, MIBK and cyclohexanone. This produces inks (solvent plus dye mixture and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets according to the present invention have bright, strong and an even grey shade which is fast to both light and heat and the effects of finger grease.

The Substrate

The substrate may be any sheet material preferably having at least one smooth even surface and capable of withstanding the temperatures involved in DDTTP, i.e. up to 400° C. for periods up to 20 msec, yet thin enough to transmit heat applied on one side through to the dyes on the other side to effect transfer of the dye onto a receiver sheet within such short periods. Examples of suitable materials are polymers, especially polyester, polyacrylate, polyamide, cellulosic and polyalkylene films, metallised forms thereof, including co-polymer and laminated films, especially laminates incorporating a smooth even polyester receptor layer on which the dye is deposited. Thin (<20 micron) high quality paper of even thickness and having a smooth coated surface, such as capacitor paper, is also suitable. A laminated substrate preferably comprises a backcoat, on the opposite side of the laminate from the receptor layer, of a heat resistant material, such as a thermosetting resin, e.g a silicone, acrylate or polyurethane resin, to separate the heat source from the polyester and prevent melting of the latter during the DDTTP operation. The thickness of the substrate depends to some extent upon its thermal conductivity but it is preferably less than 20 μm, more preferably less than 10 μm and especially between 2 and 6 μm.

Preparation of Transfer Sheet

A transfer sheet may be prepared by applying a coating of the dye, dissolved or dispersed in a suitable solvent and containing appropriate binders and/or dispersants to form an ink, to the substrate such that a wet film of ink is produced on the surface of the substrate. The ink is then dried to produce the transfer sheet.

The DDTTP Process

According to a further feature of the present invention there is provided a dye diffusion thermal transfer printing process which comprises contacting a transfer sheet comprising a coating comprising a dye mixture as hereinbefore defined with a receiver sheet, so that the coating is in contact with the receiver sheet and selectively applying heat to discrete areas on the reverse side of the transfer sheet whereby the dye mixture on the opposite side of the sheet to the heated areas is transferred to the receiver sheet.

Heating in the selected areas can be effected by contact with heating elements (pixels), which can be heated to 200°-450° C. preferably 200°-400° C., over periods of 2 to 10 msec, whereby the dye mixture may be heated to 150°-300° C., depending on the time of exposure, and thereby caused to transfer, substantially by diffusion, from the transfer to the receiver sheet. Good contact between dye sheets and receiver sheet at the point of application is essential to effect transfer. The density of the printed image is related to the time period for which the transfer sheet is heated.

The Receiver Sheet

The receiver sheet conveniently comprises a polyester sheet material, especially a white polyester film, preferably of polyethylene terephthalate (PET). Although some dyes of Formula 1 and Formula 2 are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye mixture is applied, into which the dye mixture more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dye mixtures of Formula 1 and Formula 2 give particularly strong and good quality prints (e.g. fast to light, heat and storage) on any specific transfer or receiver sheet, compared with other dyes of similar structure which have been proposed for thermal transfer printing processes. The design of receiver and transfer sheets is discussed further in EP 133,011 and EP 133012.

The invention is further illustrated by the following example in which all parts and percentages are by weight.

Ink 1

This was prepared by dissolving 1.52 parts of Dye 1, 1.52 parts of Dye 17, 1.60 parts of Dye 19, 0.68 parts of Dye 59, 4.73 parts of polyvinylbutyral (BX-1, Sekisui) and 1.18 parts of ethyl cellulose ($T_{10}$, Hercules) in 88.77 parts of tetrahydrofuran (THF) and stirring the mixture until a homogeneous solution was obtained.

Inks 2 to 10

These were prepared by the same method as Ink 1 and the compositions are shown in Table 6.

TABLE 6

| Ink | Dye 1 | Dye 17 | Dye 19 | Dye 59 |
|---|---|---|---|---|
| 2 | 1.55 | 1.47 | 1.89 | 0.43 |
| 3 | 1.55 | 1.47 | 1.36 | 0.96 |
| 4 | 1.55 | 1.74 | 1.62 | 0.43 |
| 5 | 1.55 | 1.47 | 1.76 | 0.56 |
| 6 | 1.55 | 1.47 | 1.49 | 0.83 |
| 7 | 1.42 | 1.60 | 1.62 | 0.70 |
| 8 | 1.55 | 1.60 | 1.62 | 0.56 |
| 9 | 1.55 | 1.60 | 1.49 | 0.70 |
| 10 | 1.42 | 1.47 | 1.62 | 0.83 |

Each of the Inks 2 to 10 also contain 4.70 parts of polyvinylbutyral (BX-1 , Sekisui), 1.18 parts of ethyl cellulose ($T_{10}$, Hercules) and 88.78 parts of tetrahydrofuran (THF).

Ink 11

This was prepared by the same method as Ink 1 by dissolving 0.87 parts of Dye 1, 0.83 parts of Dye 17, 0.77 parts of Dye 19, 0.54 parts of Dye 59, 2.25 parts of ethylhydroxyethylcellulose (low viscosity grade) and 2.25 parts of ethylhydroxyethylcellulose (high viscosity grade) in 92.49 parts of tetrahydrofuran (THF).

Ink 12

This was prepared by the same method as Ink 1 by dissolving 1.55 parts of Dye 1, 1.47 parts of Dye 17, 1.36 parts of Dye 19, 0.96 parts of Dye 59 and 5.58 parts of polyvinylbutyral (BX-1, Sekisui) in 88.78 parts of tetrahydrofuran (THF).

Ink 13

This was prepared by the same method as Ink 1 by dissolving 0.87 parts of Dye 1, 0.83 parts of Dye 17, 0.77 parts of Dye 19, 0.54 parts of Dye 59, 2.25 parts of ethyl cellulose ($T_{10}$, Hercules) and 2.25 parts of ethyl cellulose ($T_{200}$, Hercules) in 92.49 parts of tetrahydrofuran (THF).

Transfer Sheet TS1

This was prepared by applying Ink 1 to a 6 m polyethylene terephthalate sheet (substrate) using a wire-wound metal Meyer-bar (K-bar No. 3) to produce a wet film of ink on the surface of the sheet. The ink was then dried with hot air to give a 3 micrometre dry film on the surface of the substrate.

Transfer Sheets TS2-TS13

These were prepared in the same manner as TS1 using each of Inks 2-13 in place of Ink 1.

Printed Receiver Sheet RS1

A sample of TS 1 was contacted with a receiver sheet, comprising a composite structure based in a white polyester base having a receptive coating layer on the side in contact with the printed surface of TS 1. The receiver and transfer sheets were placed together on the drum of a transfer printing machine and passed over a matrix of closely-spaced pixels which were selectively heated in accordance with a pattern information signal to a temperature of >300° C. for periods from 3 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet.

Printed Receiver Sheets RS2 to RS13

These were prepared in the same way as RS1 using TS2 to TS13 in place of TS1.

Evaluation of Inks, Transfer Sheets and Printed Receiver Sheets

The stability of the ink and the quality of the print on the transfer sheet was assessed by visual inspection. An ink was considered stable if there was no precipitation over a period of two weeks at ambient and a transfer sheet was considered stable if it remained substantially free from crystallisation for a similar period.

The neutrality of the grey prints on the receiver sheets was assessed by obtaining the colour co-ordinates a* and b* for print times of 3–10 msec using a Minolta Chroma Meter CR-A10 with illuminant C. The respective a* b* values are shown in Table 7.

TABLE 7

| Receiver Sheet | | PRINT TIME (ms) | | | | | | | |
|---|---|---|---|---|---|---|---|---|---|
| RS | | 10 | 9 | 8 | 7 | 6 | 5 | 4 | 3 |
| 1 | a* | 1.8 | 0.9 | 0.9 | 0.9 | 0.7 | 0.4 | 0.0 | −0.2 |
| | b* | −1.1 | −0.7 | −0.5 | −0.3 | −0.2 | −0.6 | −0.9 | −1.3 |
| 2 | a* | −0.3 | −0.4 | −0.9 | −1.3 | −1.3 | −1.0 | −0.9 | — |
| | b* | −0.6 | −0.7 | −0.6 | −0.3 | 0 | −0.1 | −0.7 | — |
| 3 | a* | 0.1 | 0.4 | 0.1 | −0.8 | −0.3 | −0.5 | −0.4 | — |
| | b* | −0.4 | −0.5 | 0 | 0.7 | 0.8 | 0.6 | −0.1 | — |
| 4 | a* | 1.3 | 1.6 | 1.6 | 1.9 | 1.3 | 1.1 | 0.4 | — |
| | b* | −0.4 | −0.5 | −0.3 | −0.1 | 0.1 | 0 | −0.5 | — |
| 5 | a* | 0.1 | −0.9 | −1.2 | −1.5 | −1.6 | −1.3 | −1.0 | — |
| | b* | −1.1 | −0.5 | −0.1 | 0.1 | 0.4 | 0.1 | −0.5 | — |
| 6 | a* | −0.2 | −0.5 | −0.4 | −0.4 | −1.1 | −0.8 | −0.9 | — |
| | b* | −0.5 | −0.1 | 0.1 | 0.5 | 0.8 | 0.3 | −0.3 | — |
| 7 | a* | 1.2 | 0.7 | 0.7 | 0.8 | 0.2 | 0.3 | −0.2 | — |
| | b* | −1.5 | −1.4 | −1.4 | −1.2 | −0.9 | −1.0 | −1.3 | — |
| 8 | a* | 1.2 | 0.8 | 1.7 | 1.2 | 0.8 | 0.7 | 0.2 | — |
| | b* | −0.5 | −0.1 | −0.3 | 0.1 | 0.3 | 0 | −0.5 | — |
| 9 | a* | 1.7 | 1.6 | 1.5 | 1.3 | 1.1 | 0.6 | 0.1 | — |
| | b* | −0.9 | −0.3 | −0.1 | 0.4 | 0.7 | 0.4 | −0.3 | — |
| 10 | a* | 0.7 | 0.2 | −0.5 | −0.3 | −0.3 | −0.2 | −0.4 | — |
| | b* | −1.5 | −1.6 | −1.4 | −1.4 | −1.0 | −0.8 | −0.9 | — |
| 11 | a* | 0.6 | 1.1 | 0.8 | 0.2 | −0.1 | −0.3 | 0.8 | — |
| | b* | −0.5 | −0.8 | −0.6 | −0.2 | −0.4 | 0.8 | 0.6 | — |
| 12 | a* | 0.4 | 0.7 | 0 | −0.3 | −1.0 | −1.0 | −1.4 | — |
| | b* | 0.2 | −0.2 | 0 | 0.3 | 0.9 | 1.3 | 1.2 | — |
| 13 | a* | 0.4 | 1.0 | 1.0 | 0.6 | 0.5 | 0.6 | 1.2 | — |
| | b* | −0.6 | −1.0 | −0.8 | −0.2 | 0.6 | 0.8 | 0.3 | — |

We claim:

1. A thermal transfer printing sheet comprising a substrate having a coating comprising a binder and a black dye mixture comprising from 5 to 60% of a dye of Formula 1, from 5 to 60% of Formula 2, and at least one member of the group consisting of from 5 to 60% of a dye of formula 3 and from 1 to 60% of a dye of Formula 4 in which Dyes of Formula 1 are represented as:

wherein:

X is —H; nitro or —COOR[1] in which R[1] is an optionally substituted hydrocarbyl radical;

Y is an optionally substituted $C_{1-10}$-alkyl; optionally substituted $C_{1-10}$-alkoxy or halogen;

Z is an alkyl radical, and

R is an alkyl radical which may be interrupted by one or two —O— or —COO— links;

Dyes of Formula 2 are represented as:

$$A—N=N—E \qquad \text{Formula 2}$$

wherein:

A is the residue of adizotisable heteroaromatic amine, $A—NH_2$, in which A is selected from imidazolyl, pyrazolyl, thiazolyl, benzothiazolyl, isothiazolyl, benzoisothiazolyl, pyridoisothiazolyl; thienyl and triazolyl; and E is the residue of an aromatic coupling component, E-B, wherein B is a group displaceable by a diazotised aromatic amine and E is optionally substituted aminophenyl, tetrahydroquinolinyl, julolidyl or aminoquinolinyl;

Dyes of Formula 3 are represented as:

$$C—N=N—D—N=N—G \qquad \text{Formula 3}$$

wherein:

C is the residue of a diazotisable phenylamine or naphthylamine, $C—NH_2$, carrying not more than one unsaturated electron-withdrawing group;

D is an optionally substituted thiophen-2,5-ylene or thiazol-2,5-ylene group; and G is the residue of an aromatic coupling component G-J wherein J is a group displaceable by a diazotised aromatic amine; and Dyes of Formula 4 are represented as:

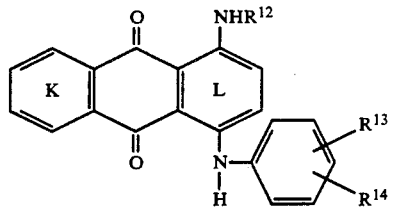

Formula 4 wherein:

$R^{12}$ is $C_{1-6}$-alkyl, $C_{4-8}$-cycloalkyl or $C_{2-6}$-alkenyl;

$R^{13}$ is $C_{1-6}$-alkyl or $C_{2-6}$-alkenyl; and $R^{14}$ is H or $C_{1-6}$-alkyl or $C_{2-6}$-alkenyl.

2. A thermal transfer printing sheet according to claim 1 wherein the black dye mixture comprises from 5 to 60% of a dye of Formula 1, from 5 to 60% of a dye of Formula 2, from 5 to 60% of a dye of Formula 3 and from 1 to 40% of a dye of Formula 4.

3. A thermal transfer printing sheet according to claim 1 wherein the black dye mixture comprises from 20 to 40% of a dye of Formula 1, from 20 to 40% of a dye of Formula 2, from 15 to 45% of a dye of Formula 3 and from 5 to 30% of a dye of Formula 4.

4. A thermal transfer printing sheet according to claim 1 wherein the black dye mixture comprises from 25 to 30% of a dye of Formula 1, from 25 to 30% of a dye of Formula 2, from 20 to 40% of a dye of Formula 3 and from 5 to 20% of a dye of Formula 4.

5. A thermal transfer printing sheet according to claim 1 wherein in the dye of Formula 1 Y is selected from $—CH_3$, $n—C_3H_7$, $n—C_4H_9$, $t—C_4H_9$, $n—CO_9H_{19}$ and —Cl; X is —H, $—NO_2$ or $—C_2C_2H_5$; Z is $—CH_3$ or $n—C_3H_7$; and R is selected from $—CH_3$, $n—C_3H_7$, $n—C_5H_{11}$, $n—C_7H_{15}$, $n—C_{11}H_{23}$, and $—CH_2OC_2H_5$.

6. A thermal transfer printing sheet according to claim 1 wherein the dye of Formula 2 is of the Formula 6:

Formula 6

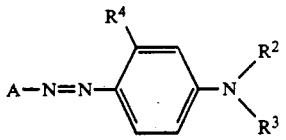

wherein:

A is selected from:

4-cyanoisothiazol-5-yl;

3-methyl-4-cyanoisothiazol-5-yl;

1-cyanomethyl-3,4-dicyanopyrazol-5-yl; pyridoisothiazol-3-yl, optionally substituted in the 5 and/or 6 positions by a group selected from cyano, nitro, methyl and methoxy; and thien-2-yl, substituted in the 3 & 5 positions by a group selected from cyano, nitro, methylaminocarbonyl and optionally substituted in the 4 position by methyl or methoxy;

$R^4$ is selected from —H, chloro, $C_{1-4}$-alkyl and $C_{1-4}$-alkylcarbonylamino; and $R^2$ & $R^3$ are selected from —H; $C_{1-4}$-alkyl and $C_{1-4}$-alkyl substituted by a group selected from $C_{1-4}$-alkoxy, $C_{1-4}$-alkoxycarbonyl, $C_{1-4}$-alkylcarbonyloxy, cyano and chloro.

7. A thermal transfer printing sheet according to claim 1 wherein the dye of Formula 2 is of Formula 7:

Formula 7

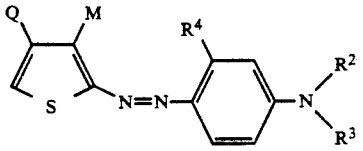

wherein:

Q is $—CH_3$ or —CN; M is —CN; $R^2$ and $R^3$ are selected from $—C_2H_5$, $n—C_4H_9$, $—C_2H_4OC_2H_5$, $—C_2H_4OCOCH_3$, $—C_2H_4OCOC_2H_5$, $—C_2H_4COOCH_3$ and $—C_2H_4CN$; and $R_4$ is —H, methyl or acetylamino.

8. A thermal transfer printing sheet according to claim 1 wherein the dye of Formula 3 is of Formula 11:

Formula 11

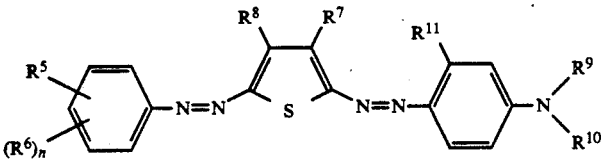

wherein:

$R^5$ is selected from —H, —CN, —SCN, $—NO_2$, $—CONT_2$, $—SO_2NT_2$, $—COT^1$, $—SO_2T^1$, $—COOT^2$, $—SO_2TO^2$, —COF, —COCl, $—SO_2F$ and $—SO_2Cl$;

each $R^6$ is independently selected from —H, —F, —Cl, —Br, $—CF_3$, $C_{1-4}$-alkyl, $C_{1-4}$-alkoxy and $—NT_2$;

n is 1, 2 or 3;

$R^7$ is selected from —CN, $—COT^1$, $—CONT_2$ and $—COOT^1$;

$R^8$ is —H or $C_{1-4}$-alkyl;

$R^9$ & $R^{10}$ are independently selected from —H, $C_{1-4}$-alkyl, phenyl, $C_{4-8}$-cycloalkyl and $C_{1-4}$-alkyl substituted by a group selected from —OH, —CN, $C_{1-4}$-alkoxy, $C_{1-4}$-alkoxy-$C_{1-4}$-alkoxy, $C_{1-4}$-alkyl-CO-, $C_{1-4}$-alkoxy-CO-, $C_{1-4}$-alkyl-COO-, halogen, $C_{1-4}$-alkoxy-$C_{1-4}$-alkoxy-CO-, $C_{1-4}$-alkoxy-COO— and phenyl; and $R^{11}$ is selected from —H, $C_{1-4}$-alkyl, $C_{1-4}$-alkoxy and $—NHCOT^1$ in which each T is independently selected from —H, $C_{1-4}$-alkyl and phenyl, $T^1$ is $C_{1-4}$-alkyl or phenyl and $T^2$ is $C_{1-4}$-alkyl.

9. A thermal transfer printing sheet according to claim 8 wherein in dyes of Formula 11 $R^5$ is selected from —H, —CN, $C_{1-4}$-alkyl-$SO_2$— and $C_{1-4}$-alkoxy—CO—; $R^6$ is selected from —H, —F, —Cl, —Br, $—CF_3$, $C_{1-4}$-alkoxy and $C_{1-4}$-alkyl; $R^7$ is —CN; $R^8$ is —H or $—CH_3$; $R^9$ is $—C_2H_5$; $R^{10}$ is $—C_2H_5$; $R^{11}$ is $C_{1-4}$-alkyl-CONH— and n is 1 or 2.

10. A thermal transfer printing sheet according to claim 1 wherein the dye of Formula 3 is of Formula 12:

Formula 12

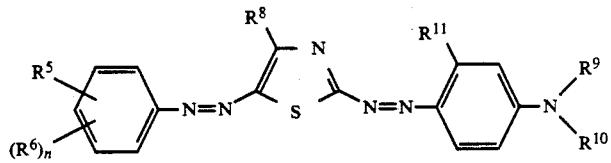

wherein:

$R^5$ is selected from —H; —CN; $—NO_2$; $—CONT_2$; $—SO_2NT_2$; $—COT^1$; $—SO_2T^1$; $—COOT^2$ and $—SO_2OT^2$;

$R^6$ is selected from —H; halogen; $—CF_3$; $C_{1-4}$-alkyl; $C_{1-4}$-alkoxy and $—NT_2$;

n is 1, 2 or 3;

$R^8$ is H or $C_{1-4}$-alkyl;

$R^9$ & $R^{10}$ are independently selected from —H, $C_{1-4}$-alkyl, phenyl, $C_{4-8}$-cycloalkyl and $C_{1-4}$-alkyl substituted by a group selected from —OH, —CN, $C_{1-4}$-alkoxy, $C_{1-4}$-alkoxy-$C_{1-4}$-alkoxy, $C_{1-4}$-alkyl-CO-, $C_{1-4}$-alkoxy-CO-, $C_{1-4}$-alkyl-COO-, halogen, $C_{1-4}$-alkoxy-$C_{1-4}$-alkoxy-CO-, $C_{1-4}$-alkoxy-COO- and phenyl; and $R^{11}$ is selected from H, $C_{1-4}$-alkyl, $C_{1-4}$-alkoxy and $—NHCOT^1$ in which each T is independently selected from —H, $C_{1-4}$-alkyl and phenyl, $T^1$ is $C_{1-4}$-alkyl or phenyl and $T^2$ is $C_{1-4}$-alkyl.

11. A thermal transfer printing sheet according to claim 10 wherein in the dye of Formula 12 $R^5$ and $R^6$ are —H; $R^8$ is —H or methyl; $R^9$ and $R^{10}$ are independently selected from ethyl, n-propyl and n-butyl, and $R^{11}$ is —H, methyl or acetylamino.

12. A thermal transfer printing sheet according to claim 1 wherein in the dyes of Formula 4 $R^{12}$ is $C_{3-5}$-alkyl; $R^{13}$ is in a para position with respect to the azo bridging group; and $R^{14}$ is —H or $C_{1-6}$-alkyl.

13. A thermal transfer printing sheet according to claim 1 wherein in the dyes of Formula 4 $R^{12}$ is selected from iso-propyl, sec-butyl, iso-butyl, t-butyl, allyl, n-propyl, 2-methylbutyl and cyclohexyl; and $R^{13}$ and $R^{14}$ are selected from methyl, ethyl, n-propyl, iso-butyl, t-butyl, n-butyl and n-hexyl.

14. A transfer printing process which comprises contacting a transfer sheet according to claim 1 to with a receiver sheet, so that the dye is in contact with the receiver sheet and selectively heating areas of the transfer sheet whereby dye in the heated areas of the transfer sheet may be transferred to the receiver sheet.

15. A transfer printing process according to claim 14 wherein the transfer sheet is heated to a temperature from 200° C. to 400° C. for a period of 2 to 10 milliseconds while in contact with the receiver sheet.

16. A transfer printing process according to claim 14 wherein the receiver sheet is white polyester film.

17. A thermal transfer printing process according to claim 14 wherein the dye mixture is transferred to the receiver sheet to produce a neutral grey shade defined by $$\sqrt{a^{*2} + b^{*2}} \leqq 5.0$$

wherein a* and b* represent the chromaticity co-ordinates in the CIELAB system for quantifying surface colons.

18. A thermal transfer printing process according to claim 14 wherein the neutral grey shade is defined by $$\sqrt{a^{*2} + b^{*2}} \leqq 2.5$$

wherein a* and b* represent the chromaticity co-ordinates in the CIELAB system for quantifying surface colons.

19. A thermal transfer printing process according to claim 14 wherein the neutral grey shade is defined by $$\sqrt{a^{*2} + b^{*2}} \leqq 2.0$$

wherein a* and b* represent the chromaticity co-ordinates in the CIELAB system for quantifying surface colons.

20. A process for the preparation of a thermal transfer printing sheet according to claim 1 which comprises applying an ink comprising 0.1 to 10% of the dye mixture and 0.1 to 10% of the binder in a solvent to the substrate and evaporating the solvent to produce a coating of the dye and binder on the substrate.

21. A thermal transfer printing sheet according to claim 1 wherein the substrate is $<20$ μm in thickness and is capable of withstanding temperatures up to 400° C. for up to 20 milliseconds and is selected from the group consisting of paper, polyester, polyacrylate, polyamide, cellulosic and polyalkylene films, metallised forms of paper or of said films, and co-polymer and laminated films.

22. A thermal transfer printing sheet according to claim 21 wherein the substrate is a laminate incorporating polyester receptor layers.

23. A thermal transfer printing sheet according to claim 1 wherein the binder is any polymeric material suitable for binding the dye to the substrate.

24. A thermal transfer printing sheet according to claim 1 wherein the ratio of binder to a mixture of dyes of Formula 1, Formula 2, Formula 3 and Formula 4 is from 1:1 to 4:1.

25. A thermal transfer printing sheet according to claim 1 wherein the binder is selected from ethyl hydroxycellulose, hydroxpropylcellulose, methylcellulose, ethylcellulose, cellulose acetate, cellulose acetate butyrate; starch, alginic acid, alkyd resins, polyvinylalcohol, polyvinyl butyral, polyvinyl pyrrolidone; polyacrylic acid, polymethylmethacrylate and styrene-acrylate co-polymers, polyester resins, polyamide resins, polyurea, polyurethane resins, organosilicones, epoxy resins, natural resins, gum tragacanth and gum arabic.

* * * * *